US010144142B1

(12) United States Patent
Squires et al.

(10) Patent No.: US 10,144,142 B1
(45) Date of Patent: Dec. 4, 2018

(54) SPACER FOR RAZOR BLADE FOR CREATING AND MAINTAINING A STUBBLE SHAVE APPEARANCE

(71) Applicants: Blake Squires, Akron, OH (US); John D. Osher, Fort Lauderdale, FL (US)

(72) Inventors: Blake Squires, Akron, OH (US); John D. Osher, Fort Lauderdale, FL (US)

(73) Assignee: STUBL LLC, Akron, OH (US)

( * ) Notice: Subject to any disclaimer, the term of this patent is extended or adjusted under 35 U.S.C. 154(b) by 0 days.

(21) Appl. No.: 15/489,992

(22) Filed: Apr. 18, 2017

Related U.S. Application Data

(60) Provisional application No. 62/325,545, filed on Apr. 21, 2016, provisional application No. 62/410,591, filed on Oct. 20, 2016.

(51) Int. Cl.

| | |
|---|---|
| ***B26B 21/40*** | (2006.01) |
| ***B26B 21/52*** | (2006.01) |
| ***B26B 21/22*** | (2006.01) |
| ***B26B 21/42*** | (2006.01) |

(52) U.S. Cl.
CPC ..... *B26B 21/4037* (2013.01); *B26B 21/225* (2013.01); *B26B 21/42* (2013.01); *B26B 21/522* (2013.01)

(58) Field of Classification Search
CPC .. B26B 21/4018; B26B 21/4037; B26B 21/42
USPC ..... 30/30, 31, 47–51, 537, 539, 233.5; D28/46, 49, 53
See application file for complete search history.

(56) References Cited

U.S. PATENT DOCUMENTS

| | | | | | |
|---|---|---|---|---|---|
| 797,184 | A | * | 8/1905 | Deneen | B26B 21/08 30/31 |
| 1,333,315 | A | | 3/1920 | Jacquat | |
| 1,419,187 | A | * | 6/1922 | Wilson | B26B 21/42 30/31 |
| 1,493,962 | A | * | 5/1924 | Cowan | B26B 21/16 30/31 |
| 1,897,982 | A | | 2/1933 | Jones | |
| 2,046,006 | A | | 6/1936 | Taylor | |
| 2,165,391 | A | * | 7/1939 | Lewis | B26B 21/08 30/31 |
| 2,171,880 | A | * | 9/1939 | Lewis | B26B 19/20 30/537 |
| D123,180 | S | * | 10/1940 | Pileggi | D28/52 |
| 2,234,440 | A | * | 3/1941 | Lewis | B26B 21/08 30/30 |
| 2,237,676 | A | * | 4/1941 | Lewis | B26B 21/08 30/30 |
| 2,612,684 | A | | 10/1952 | Mansfield | |

(Continued)

FOREIGN PATENT DOCUMENTS

| | | | | |
|---|---|---|---|---|
| FR | 2833815 B1 | * | 2/2004 | B26B 21/4037 |
| FR | 2918305 A1 | * | 1/2009 | B26B 21/4037 |

(Continued)

*Primary Examiner* — Jason Daniel Prone
(74) *Attorney, Agent, or Firm* — Walter | Haverfield LLP; James J. Pingor

(57) ABSTRACT

A razor blade assembly that is capable of creating a stubble-like appearance via a manual, low-cost razor. The assembly includes a spacer that maintains a gap or clearance between a blade edge and a surface to be shaved. This gap or clearance facilitates an effect of a shadow- or stubble-like appearance upon the surface.

15 Claims, 8 Drawing Sheets

(56) References Cited

U.S. PATENT DOCUMENTS 2,634,496 A 4/1953 Halen
2,670,533 A 3/1954 Kearney
3,183,589 A * 5/1965 Szabo ..... B26B 21/08 30/30
3,203,093 A 8/1965 Kuhnl
3,219,180 A * 11/1965 Rosen ..... B65D 83/10 30/40.2
D205,453 S * 8/1966 Christensen ..... D28/52
3,263,328 A 8/1966 Craig
3,289,295 A 12/1966 Tornvall
D210,713 S * 4/1968 Hamill ..... 30/539
3,388,468 A * 6/1968 Hamill ..... B26B 21/40 30/540
D226,642 S * 4/1973 Ferrier ..... 30/539
3,816,913 A 6/1974 Ferraro
3,816,916 A 6/1974 Kuhnl
3,909,942 A 10/1975 Ciaffone
3,964,159 A 6/1976 Ferraro
3,986,258 A * 10/1976 Liedtke ..... B26B 21/08 30/233.5
4,094,066 A * 6/1978 Daniel, Jr. ..... B26B 21/4006 30/77
4,265,015 A 5/1981 Asano
4,345,374 A 8/1982 Jacobson
4,346,721 A * 8/1982 Molaro ..... B26B 21/12 132/313
4,476,630 A * 10/1984 Byrne ..... B26B 21/52 30/47
4,663,841 A 5/1987 Custer
4,709,476 A * 12/1987 Shurtleff ..... B26B 21/44 30/84
4,724,614 A 2/1988 Wahl et al.
D312,144 S * 11/1990 Buba ..... D28/52
5,095,621 A * 3/1992 Rapp ..... B26B 21/4037 30/539
5,386,750 A 2/1995 Morrison
5,388,332 A * 2/1995 Oldroyd ..... B26B 21/4012 30/49
5,410,810 A * 5/1995 Gillibrand ..... B26B 21/4025 30/50
5,771,592 A * 6/1998 Nizker ..... B26B 21/40 30/540
5,813,293 A * 9/1998 Apprille, Jr. ..... B26B 21/225 30/47
5,893,213 A * 4/1999 Motta ..... B26B 21/4037 30/539
6,094,820 A * 8/2000 Adachi ..... B26B 21/12 30/30
6,185,827 B1 * 2/2001 Polites ..... B26B 21/40 30/539
6,249,973 B1 * 6/2001 Hirano ..... B26B 21/12 30/30
D449,710 S * 10/2001 Wonderley ..... D28/46
6,539,633 B1 * 4/2003 Rebaudieres ..... B26B 21/4037 30/539
D499,511 S * 12/2004 Wakayama ..... D28/46
D509,322 S * 9/2005 Wonderley ..... D28/46
D541,987 S * 5/2007 Sugawara ..... D28/46
7,322,109 B2 1/2008 Newkirk et al.
D568,534 S * 5/2008 Micinilio ..... D28/46
D602,634 S * 10/2009 Cataudella ..... D28/46
D616,147 S * 5/2010 Adams ..... D28/46
D616,148 S * 5/2010 Wonderley ..... D28/47
D616,149 S * 5/2010 Wonderley ..... D28/47
D616,606 S * 5/2010 Adams ..... D28/47
D617,497 S * 6/2010 Goodhead ..... D28/47
D619,300 S * 7/2010 Wonderley ..... D28/47
D619,301 S * 7/2010 Wattam ..... D28/47
D620,196 S * 7/2010 Nicoll ..... D28/47
D624,242 S * 9/2010 Bridges ..... D28/47
D630,377 S * 1/2011 Wattam ..... D28/46
7,954,244 B2 * 6/2011 Orloff ..... B26B 21/42 30/50
8,015,710 B1 * 9/2011 Zyla ..... B26B 21/4037 30/537
8,739,411 B2 * 6/2014 Kinghorn ..... B26B 21/42 30/30
9,751,226 B2 * 9/2017 Psimadas ..... B26B 21/225
9,919,441 B2 * 3/2018 Drori ..... B26B 21/42
2002/0083600 A1 * 7/2002 Donovan ..... B26B 21/14 30/539
2004/0103538 A1 6/2004 Dansreau et al.
2005/0066527 A1 * 3/2005 Wakayama ..... B26B 21/4006 30/41
2007/0151108 A1 7/2007 Westerhof et al.
2009/0007442 A1 * 1/2009 Kurihara ..... B26B 21/10 30/537
2010/0011586 A1 * 1/2010 Nicoll ..... B26B 21/225 30/34.1
2010/0058595 A1 * 3/2010 Walker, Jr. ..... B26B 21/225 30/77
2011/0094108 A1 * 4/2011 Wain ..... B26B 21/4018 30/77
2011/0203124 A1 * 8/2011 Bridges ..... B26B 21/4037 30/539
2011/0225833 A1 * 9/2011 Hoffman ..... B26B 21/4037 30/538
2012/0137524 A1 6/2012 Mikula et al.
2013/0199346 A1 8/2013 Psimadas et al.
2016/0318198 A1 * 11/2016 Brazley ..... B26B 21/4037
2017/0210020 A1 * 7/2017 Bozikis ..... B26B 21/42
2017/0266826 A1 * 9/2017 Kole ..... B26B 21/4062

FOREIGN PATENT DOCUMENTS

GB 2461337 B * 9/2012 ..... B26B 21/4037
WO WO 2006108175 A1 * 10/2006 ..... B26B 21/4018
WO WO 2010003510 A3 * 3/2010 ..... B26B 21/4037
WO WO 2016036238 A2 * 3/2016 ..... B26B 21/4037
WO WO 2017137849 A1 * 8/2017 ..... B26B 21/42

* cited by examiner

SPACER FOR RAZOR BLADE FOR CREATING AND MAINTAINING A STUBBLE SHAVE APPEARANCE

CLAIM OF PRIORITY

This application claims priority to provisional patent application Ser. Nos. 62/325,545 filed on Apr. 21, 2016 and 62/410,591 filed on Oct. 20, 2016, the entirety of each is hereby incorporated by reference.

BACKGROUND OF THE DISCLOSURE

The present exemplary embodiment relates to razor blades for shaving. More particularly, it relates to a razor which has a blade that can adjusted to create and maintain a "stubble" appearance without the need to grow a beard (BE, FIG. 1) and then shave it off every several days.

Referring again to FIG. 1, existing disposable razors employ fixed blades which have a predetermined depth to obtain a "clean shave" (CS). Electric trimmers, on the other hand, often employ mechanisms by which to adjust the trimmer depth to obtain a desired depth or hair length.

A "stubble" (ST, FIG. 1) appearance is popular among young men, such as between the ages of 18-35, and in particular celebrities, actors, musicians, athletes, etc. However, there is no existing low cost option is to create a "stubble" appearance (ST, FIG. 1) such as by using a manual razor. An electric trimmer may be able to create or maintain the "stubble" appearance; however, electric trimmers are costly with no acceptable lower cost alternative available. Also, electric trimmers may not be able to provide a wide range of consistent "stubble" shaves and may create bald spots in certain areas with closer stubble shaves.

Thus, there is a need for a manual, low cost device whereby a blade depth can be easily created and maintained by a shim or spacer to create and consistently maintain a "stubble" appearance.

SUMMARY OF THE DISCLOSURE

The present disclosure relates to razor blades. More particularly, it relates to a cap or spacer which is used to adjust the blade depth by spacing the blade from the user's skin to create and maintain a "stubble" appearance.

In accordance with a preferred embodiment of the disclosure, a razor blade assembly includes a handle; a head having a blade assembly having one or more blades connected to the handle; and a spacer or cap which is mounted to and positioned over the head and is adjusted to create and maintain a "stubble" shave such as between about 0.45 mm to 1.25 mm in thickness.

In accordance with another embodiment of the disclosure, a cap for adjusting blade thickness of a razor blade has a body having first and second side walls, a top wall and a bottom wall connected to the first and second side walls; a first protruding wall extending from the top wall and second protruding wall extending from the bottom wall, and a plurality of ribs extending between the top wall and the bottom wall. The ribs are adapted to space the cutting edge of the razor blade a predetermined distance from a surface to be shaved.

In accordance with another embodiment of the disclosure, a method of creating and maintaining a stubble shave appearance on the skin of user includes: providing a razor blade assembly having a handle and a head comprising blades; providing a cap or spacer which is mounted to and positioned over the head to space the cutting edges of the blades from the skin to create and maintain a stubble shave appearance in the range of 0.45 mm thickness to 1.25 mm thickness.

In accordance with another embodiment of the disclosure, a razor blade is provided with interchangeable spacers which can be removably attached to a blade receiver portion of a razor thereby controlling or otherwise limiting the depth of the blade relative to a shaving surface (e.g. 0.45 mm, 0.85 mm, 1.25 mm, etc.).

The razor blades can create and maintain a "stubble" shave appearance in the range of about 0.4 mm to 1.25 mm in beard thickness.

In accordance with another embodiment of the disclosure, a removable spacer in the form of a cap or spacer is provided for a manual, disposable razor.

In accordance with another embodiment of the disclosure, the razor blade and spacer can be used in a dry shave scenario wherein no creams are used since the blade does not actually contact the skin.

In accordance with another embodiment of the disclosure, the blade cap can be adjusted to fit on virtually any commercially available razor blade.

In accordance with another embodiment of the disclosure, a razor blade kit is provided which includes a razor handle, blades, and interchangeable caps of various thickness admissions.

In accordance with another embodiment of the disclosure, the caps can be snapped and or clicked onto the blade body.

In accordance with another embodiment of the disclosure, the razor cap can be used with cream, oil, foam or lotion.

Still other aspects of the disclosure will become apparent upon a reading and understanding of the following detailed description.

DETAILED DESCRIPTION OF THE DISCLOSURE

With reference now to FIGS. 2-11, a preferred embodiment of a razor blade and cap is shown and described. The Figures illustrate a preferred embodiment of the disclosure only is not limited to the embodiments of the Figures.

Figure 1:
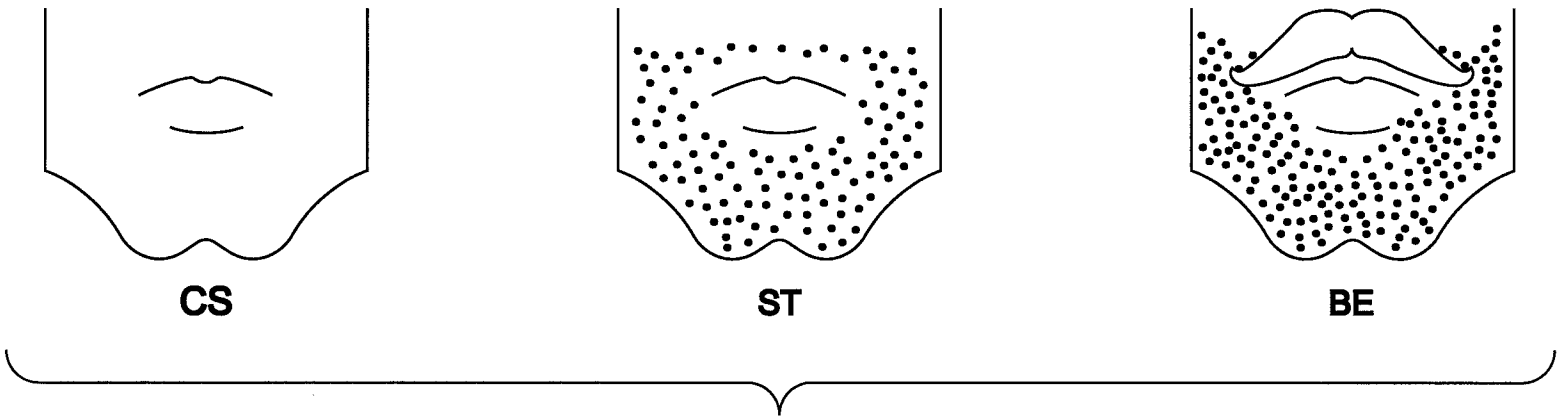
FIG. 1 illustrates a view with a close shave, a "stubble" shave, and a beard.
Figure 2:
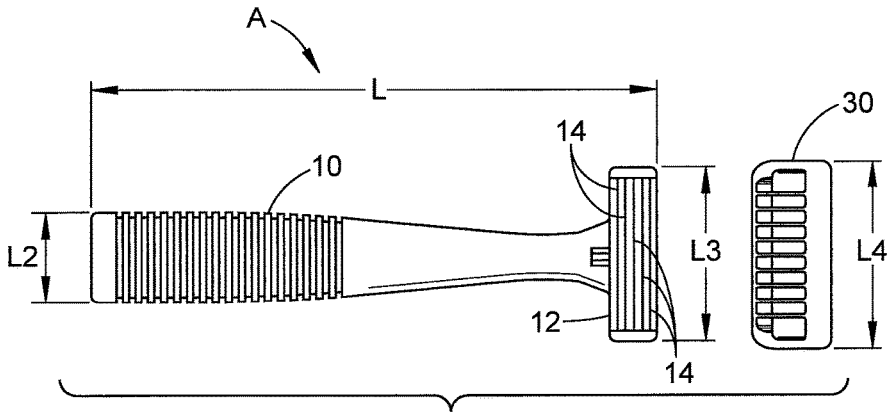
FIG. 2 is a top plan view of a razor blade and handle assembly and a cap in accordance with one embodiment of the disclosure.

Referring to FIG. 2, a disposable razor blade assembly A includes a handle 10 and a head 12 which receives blades 14. The blade head is preferably snapped into and locks into the upper end of the handle and tabs 16 or other locking mechanisms may be snapped or moved to disengaging the blade head from the handle.

The handle 10 may be rectangular or cylinder in conformation and may taper from a narrow end 18 adjacent the blade head to a wider end 20 for gripping comfort. For example, the length L of the handle can be 134 mm and length L2 of the wide end 20 may be 22 mm. The blade head itself can be about 0.40 mm long (L3). One embodiment of a spacer or cap 30 preferably has a length L4 of about 0.45 mm.

Figure 3:
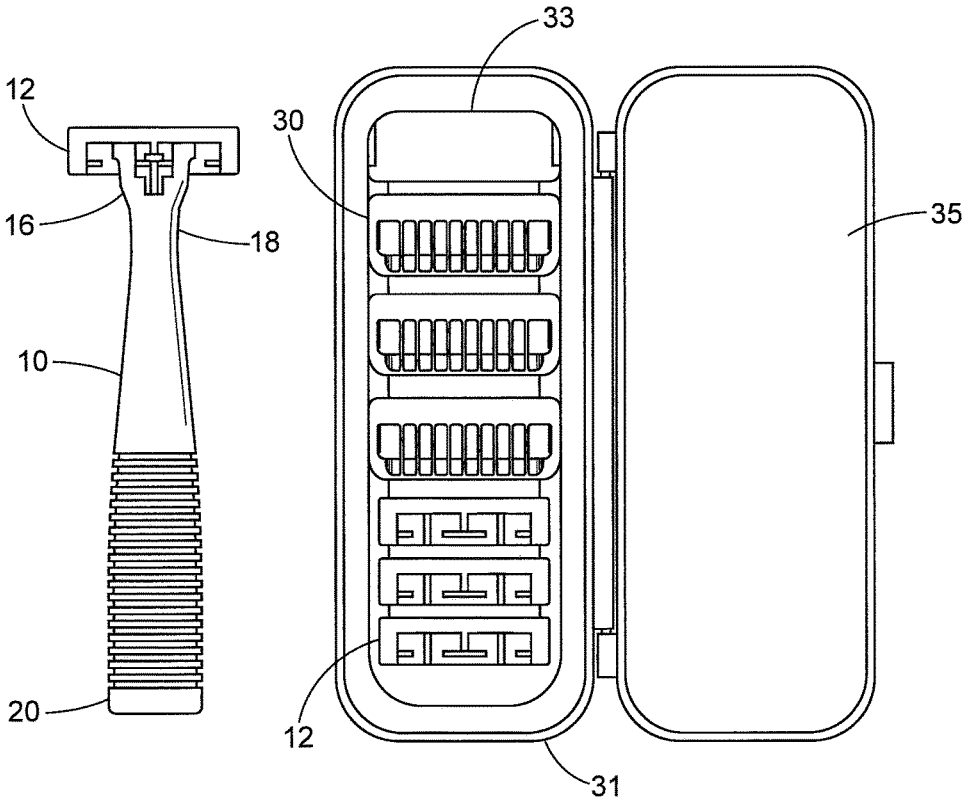
FIG. 3 is a top plan view of a carrying case and razor blade and cap in accordance with another embodiment of the disclosure.

Referring now to FIG. 3, a carrying case 31 such as with a clam-shell style housing 33 and a cover 35 is shown which can for example conveniently house the razor blade handle 10, three blades 14, and three or four spacers such as shims or caps 30.

Figure 4:
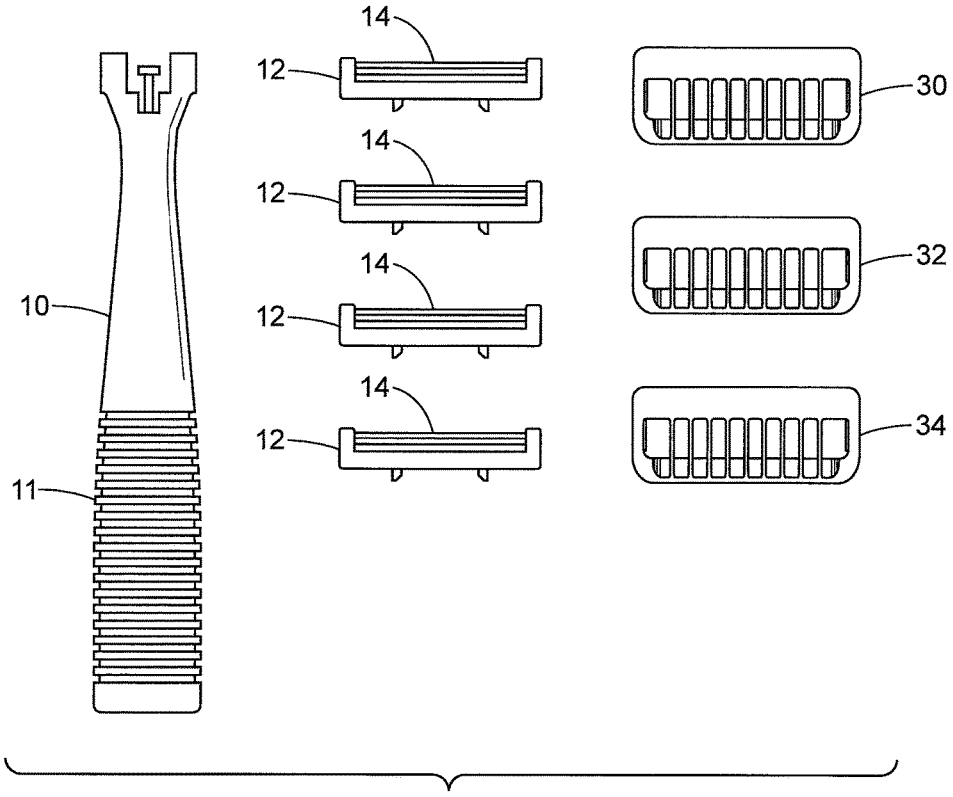
FIG. 4 is a top plan view of a handle, blades and caps in accordance with another embodiment of the disclosure

FIG. 4 illustrates the handle 10 which may have ridges or knurls 11 forming an improved ergonomic design for easy gripping, the blades 14, and three caps or spacers 30, 32, 34.

The caps can be the same gauges or different gauges. "Gauge" refers to the thickness of the desired shave, e.g., a 0.45 mm gauge refers to a 0.45 mm thickness beard. As an example, cap 30 has gauge of 0.45 mm, cap 32 has a gauge of 0.85 mm, while cap 34 has a gauge of 1.25 mm. These gauge caps would be used to achieve a "stubble" shave. Of course, many other gauges are contemplated by the disclosure. The 0.45 mm gauge cap preferably results in a 0.45 mm thick stubble beard since it spaces and positions the blades approximately 0.45 mm from the skin, the 0.85 mm gauge cap provides approximately a 0.85 mm thick stubble beard, while a 1.25 mm gauge cap provides approximately a 1.25 mm thick stubble beard. The caps can be made of any suitable material, such as plastic or metal but slightly flexible plastic is preferred. The caps made from molds, extrusions or any suitable manufacturing method.

Referring now to FIGS. 5-11, the details of the cap 30 are shown and explained in detailed. The cap 30 shown is a 0.45 mm gauge cap used for maintaining a stubble shave. The cap has two opposed side walls 36, 38 which are parallel to each other, a first or back wall 40 and a second or front wall 42 which can be perpendicular to side walls 36, 38.

Side walls 36 and 38 are preferably tapered or angled resulting in the top wall being positioned at an angle with respect to the bottom wall. A series of cavities 45 are formed between walls 36, 38, 40, 42. A first extension or top wall 44 extends from an upper end 46 of wall 40 and between side walls 36, 38, while a second extension or bottom wall 48 extends from bottom wall 42 and between side walls 36, 38. The walls 44, 48 add rigidity may aid in mounting the cap to the blade head.

Figure 5:
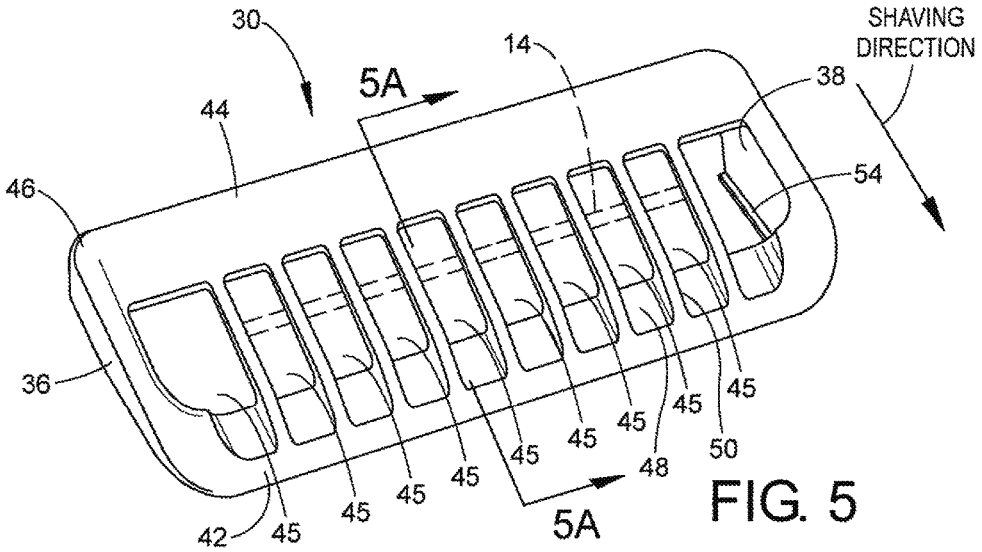
FIG. 5 is a perspective view of a blade cap in an upright position and positioned over a blade cutting edge in accordance with another embodiment of the disclosure.
Figure 5A:
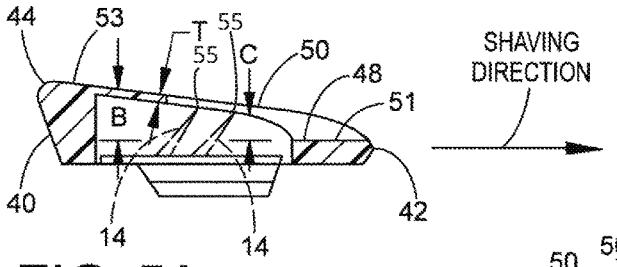
FIG. 5A is a cross-sectional view taken along line 5A of FIG. 5.
Figure 6:
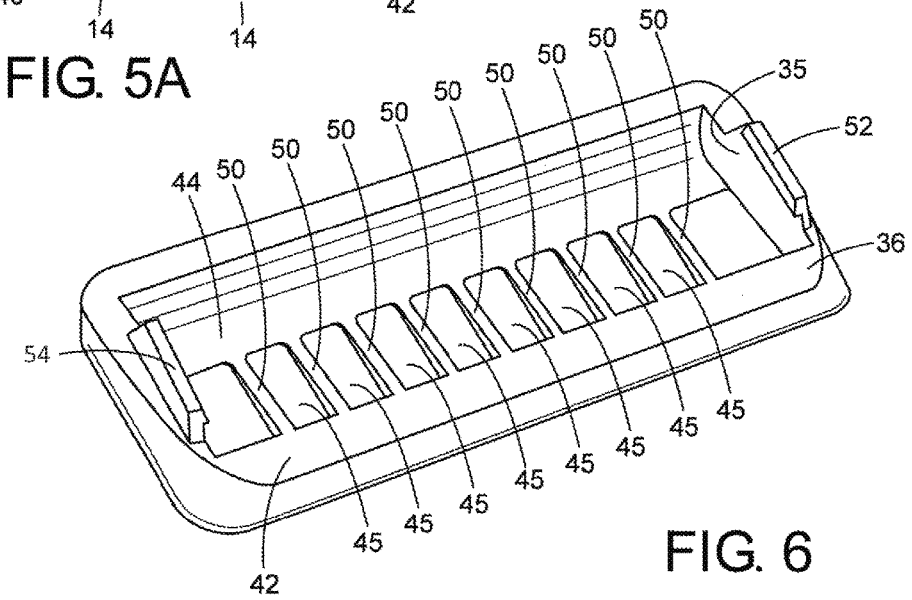
FIG. 6 is a bottom plan view of the blade cap of FIG. 5.
Figure 8:
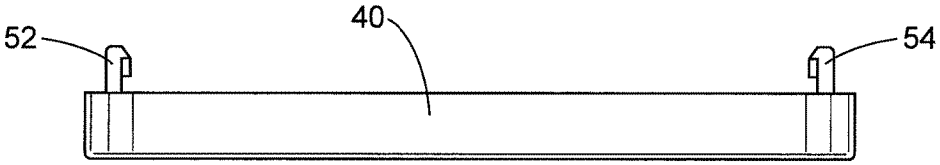
FIG. 8 is a rear elevational view of the cap of FIG. 5.
Figure 7:
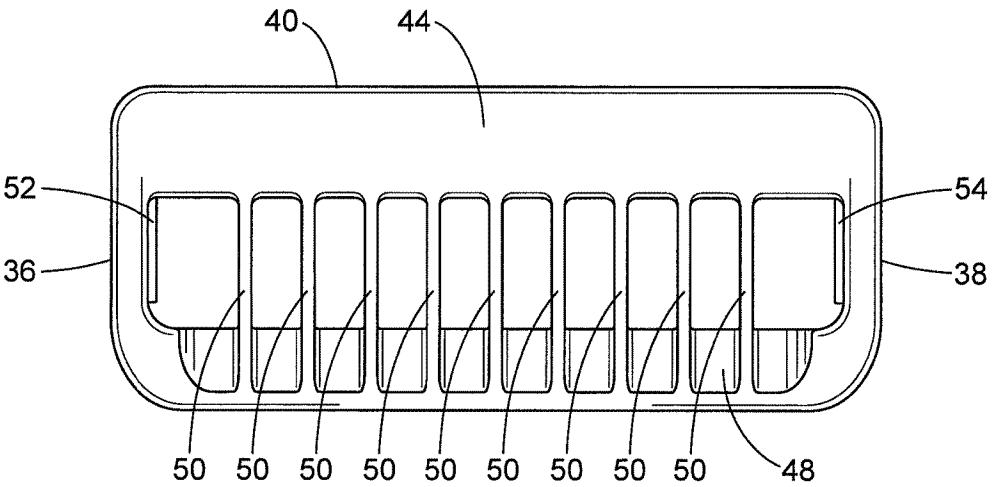
FIG. 7 is a top plan view of the cap of FIG. 5.
Figure 9:
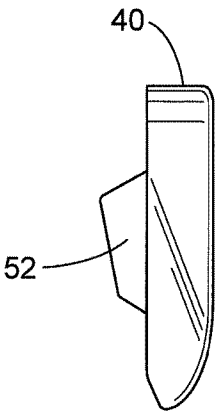
FIG. 9 is side elevational view of the cap of FIG. 5.
Figure 10:
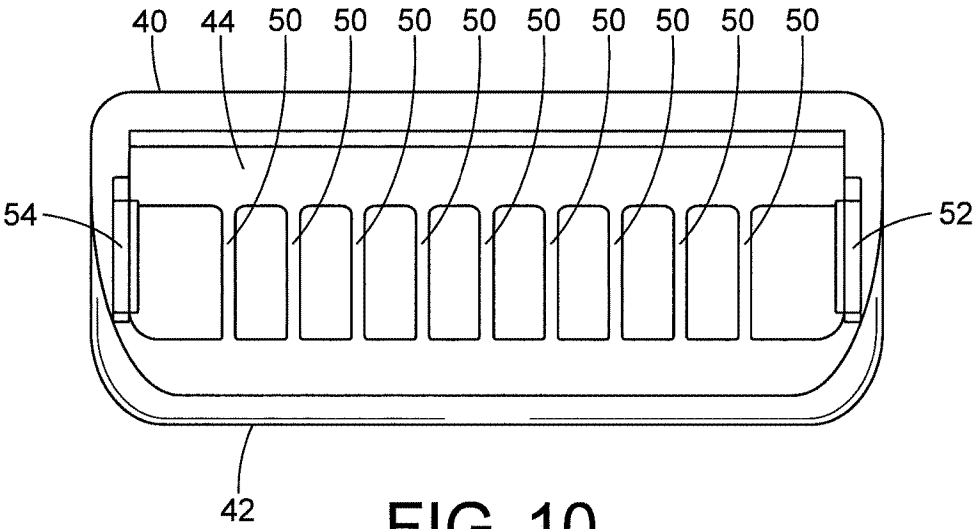
FIG. 10 is a bottom plan view of the cap of FIG. 5.
Figure 11:
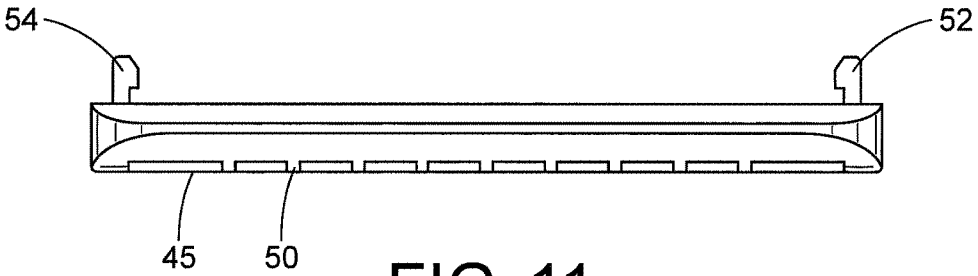
FIG. 11 is a front elevational view of the cap of FIG. 5.

Wall 48 serves as a facial hair receiving or entry surface. Referring to FIG. 5A, surface 51 of wall 48 is spaced or positioned below surface 53 of wall 44 by dimension "B" and below an upper edge 55 of a cutting blade 14 by dimension "C". This allows the hair to be cut to not bend over or get crimped and to engaged by the cutting edges 55 of blades 14. The ribs or facial hair guards 50 engages the skin or face of the user and serves to space the surface to be shaved from the blade cutting edge to result in a specific hair length (referred to as the gauge thickness). The shaving direction is shown in FIGS. 5 and 5A. The rear or back wall 44 can serve as a stop surface for preventing further cutting and also can facilitate removal of the cut hair from the face of the user when the cut hair contacts the wall 44.

Several ribs or facial hair guides 50 extend between and connect wall 44 and wall 48 together. The ribs may be chamfered and tapered or angled between walls 44 and 48. Nine ribs are shown, but other numbers are contemplated by the disclosure. The ribs preferably form a grid and due to the thickness of the ribs serve to space the cutting edge of the blade from the user's skin. This is what achieves the "stubble shave". Thus, the thicker the ribs, the thicker (i.e., the higher gauge) the shave (i.e., the hair is longer). The thinner (i.e., the smaller gauge) the ribs, the closer the shave. In this example, the ribs have a thickness T of about 0.45 mm to form a 0.45 mm thick beard which is referred to as stubble or a "stubble shave".

The ribs 50 of the cap thus are able to create and maintain a certain thickness of shave, commonly referred to as a "stubble shave". The optimum thickness for a "stubble" shave appearance is in the range of 0.45 mm to 1.25 mm in thickness. Thus, the various thickness T of the ribs can be about 0.45 mm, 0.85 mm, 1.25 mm. Other thicknesses are contemplated by the disclosure.

The caps 30, 32, 34 have a gauge thickness ranging from about 0.45 mm to about 1.25 mm to create a "stubble shave". The caps can have various size grids and various numbers of ribs and may be configured to fit various blades such as two, three, four, five or six blades. FIGS. 7-11 show various views of the structure of the cap 30.

Two resiliently biased clips 52, 54 are formed on and protrude from opposite side walls 36, 38 for attaching the cap onto a blade by snapping or clicking the cap onto the sides of the blade head. The clips are slightly flexed outwardly and snap into place to retain the clip onto the blade itself. As an alternative, the cap can be formed as part of the head itself to provide a complete integral and disposable unit.

Figure 15:
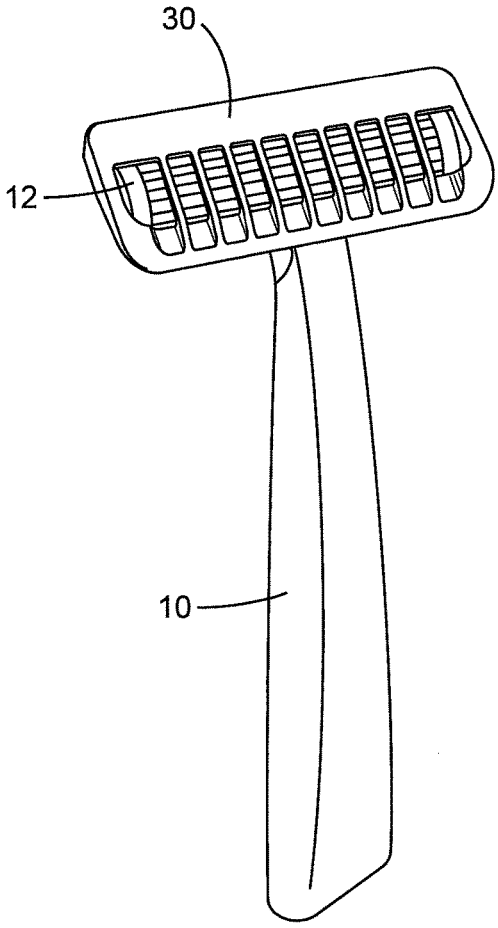
FIG. 15 is a perspective view of the cap installed on a razor blade in an in-use position in accordance with another embodiment of the disclosure.

By placing the cap 30 directly on the blade head 12 directly above the blades 14 (see FIG. 15), various thicknesses of shave can be easily obtained. Thus, there is no longer a need to grow a beard for one to three days and then shave it off and repeating the process to maintain the "stubble" look. The cap of the preferred embodiment allows the user to easily and uniformly and consistently create and maintain the "stubble" look with either a manual, disposable razor or an electric trimmer.

Figure 12:
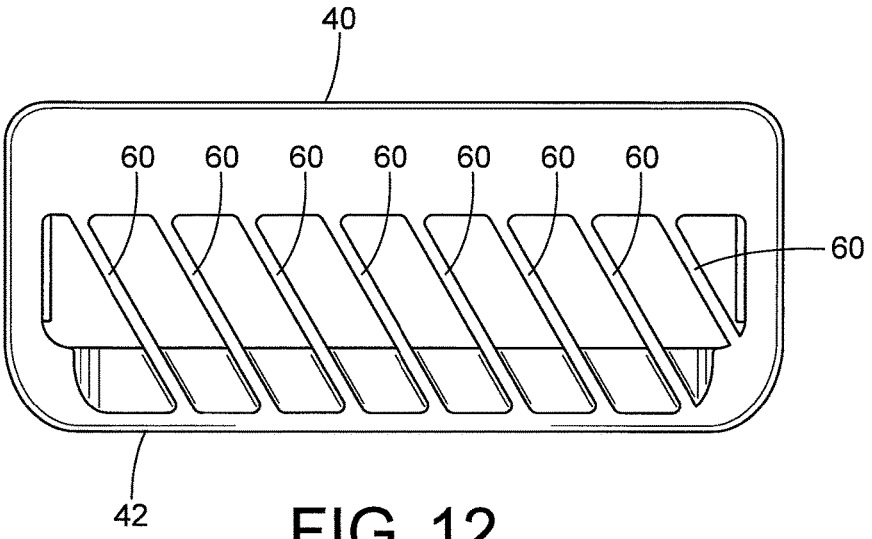
FIG. 12 is a top plan view of a cap with angled ribs at a 45 degree angle in accordance with another embodiment of the disclosure.
Figure 13:
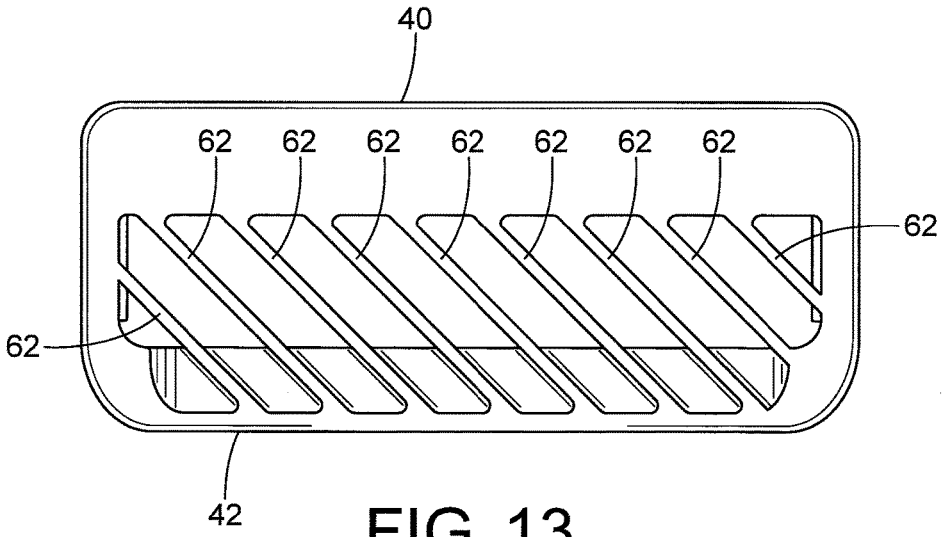
FIG. 13 is a top plan view of a cap with angled ribs at a 60 degree angle in accordance with another embodiment of the disclosure.

Referring to FIG. 12, in accordance with another embodiment of the disclosure, the ribs 60 may be angled at 45 degrees with respect to walls 40, 42. Referring to FIG. 13, the ribs 62 may be angled at 60 degrees with respect to walls 40, 42. By angling the ribs, a smoother shave may occur and possible bald spots can be minimized on the user's face.

The caps can also be adjustable and can be hinged or rotatably connected to the blade such that the cap can be rotated into position over the blade when the stubble shave is desired and then be rotated away from the blade so the blade can perform a close shave on the other areas of the user's face.

Figure 14:
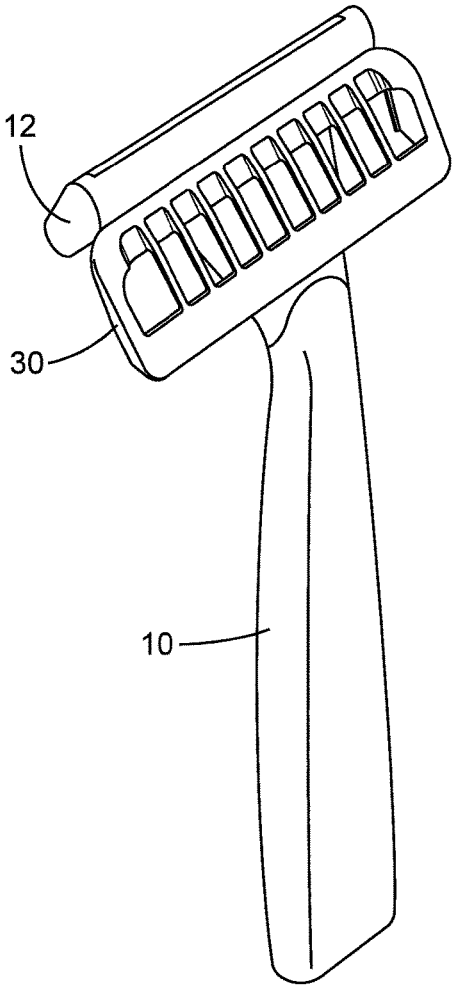
FIG. 14 is a perspective view of a cap installed on a razor blade in a storage position in accordance with another embodiment of the disclosure.

Referring to FIG. 14, the cap 30 may be snapped or removably secured to the rear of the blade head in a storage position.

The cap can also be provided directly on the blade head or can be formed as part of the blade head for a particular gauge beard thickness as a complete, disposable unit including the blade head and handle. The cap also can be removable and reusable.

The cap can be provided separately, as a disposable, and with a variety of item commercially available manual razors, such as Gillette®, Harry's®, Schick®, Dollar Shave Club®, etc. and can be provided with the razor and blade. The cap can also be provided with electric trimmers. The cap can also be provided directly on the blade for a particular beard thickness. The cap and blade can be a complete unit which is disposable. The cap also can be replaceable or reusable.

The embodiments discussed above are illustrative only. Various other embodiments are encompassed by and contemplated by the disclosure and the appended claims.

The invention claimed is:

1. A razor blade assembly comprising: a head comprising a blade assembly comprising one or more blades, wherein the head is configured to be attached to a handle, and a spacer mounted to and positioned over said the head, wherein the spacer, in an upright position, comprises a first side wall, a second side wall, a top wall having a top wall top surface, a front wall having a front wall top surface, and a plurality of ribs positioned between the first side wall and the second side wall traversing between the top wall and the front wall, and wherein the top wall top surface, the front wall top surface and a top surface of the plurality of ribs define a single surface, and wherein the plurality of ribs creates a gap between a sharpened edge of the one or more blades and a surface to be shaved.

2. The razor blade assembly of claim 1, further comprising a handle that is removably attached to the head.

3. The razor blade assembly of claim 1, wherein the spacer is removably mounted onto said head.

4. The razor blade assembly of claim 1, wherein the plurality of ribs are tapered between the top wall and the front wall.

5. The razor blade assembly of claim 1, wherein a subset of the plurality of ribs are inclined between the top wall and the front wall.

6. The razor blade assembly of claim 1, wherein the first side wall comprises a first resilient clip and the second side wall comprises a second resilient clip, wherein the first and second clips secure the spacer to the head beneath each of the first side wall and the second side wall.

7. The razor blade assembly of claim 1, wherein the plurality of ribs have a thickness in a range of 0.45 mm to 1.25 mm.

8. The razor blade assembly of claim 1, wherein the gap between the sharpened edge of the one or more blades and the surface to be shaved is in a range of 0.45 mm to 1.25 mm in thickness.

9. A method of creating and maintaining a stubbled shave appearance on a skin surface of a user; comprising the steps of: providing a razor blade assembly of claim 1; placing the spacer upon a skin surface of a user; and shaving the skin surface of the user via the sharpened edge of the one or more blades wherein the spacer facilitates the stubble shave appearance.

10. The method of claim 9 further comprising removably attaching the spacer to the head via a flexible side mounting clip on each of the first side wall and the second side wall of the spacer.

11. The method of claim 10, wherein each of the flexible side mounting clips secure the spacer to an underside of a respective side of the head.

12. The method of claim 9 wherein the razor blade assembly further comprising a handle that is removably attached to the head.

13. The method of claim 9, wherein the plurality of ribs are tapered between the top wall and the front wall.

14. The method of claim 9, wherein the ribs have a thickness in a range of 0.45 mm to 1.25 mm.

15. The method of claim 9, wherein the gap between the sharpened edge of the one or more blades and the surface to be shaved is in a range of 0.45 mm to 1.25 mm in thickness.

* * * * *